US005597786A

United States Patent [19]

Itoh et al.

[11] Patent Number: 5,597,786

[45] Date of Patent: Jan. 28, 1997

[54] LUBRICANT FOR PLASTIC WORKING

[75] Inventors: Humitaka Itoh, Sabae; Toru Makino, Fukui; Masayasu Katoh, Katsuyama; Toshio Gensho, Fukui, all of Japan

[73] Assignee: Nicca Chemical Co., Ltd., Fukui, Japan

[21] Appl. No.: 453,138

[22] Filed: May 30, 1995

[30] Foreign Application Priority Data

May 31, 1994 [JP] Japan ..... 6-118652
Feb. 2, 1995 [JP] Japan ..... 7-016176

[51] Int. Cl.[6] ..... C10M 173/02; C10M 129/34

[52] U.S. Cl. ..... 508/506; 508/219; 508/512

[58] Field of Search ..... 252/49.3

[56] References Cited

U.S. PATENT DOCUMENTS 3,654,153 4/1972 Nikitin et al. ..... 252/49.3
4,454,050 6/1984 Bertell ..... 252/49.3
4,781,847 11/1988 Weitz ..... 252/49.3
5,002,675 3/1991 Randisi ..... 252/49.3
5,171,903 12/1992 Koyama et al. ..... 252/49.3
5,348,672 9/1994 Ohkura et al. ..... 252/49.3

FOREIGN PATENT DOCUMENTS 58-84898 5/1983 Japan .
60-1293 1/1985 Japan .
1-299895 12/1989 Japan .

*Primary Examiner*—Ellen M. McAvoy
*Attorney, Agent, or Firm*—McAulay Fisher Nissen Goldberg & Kiel, LLP

[57] ABSTRACT

A lubricant for plastic working contains 0.01–40 wt % of an alkali metal salt of an alicyclic polyvalent carboxylic acid, 0.01–20 wt % of a water-soluble polymeric compound, and 0.01–40 wt % of a thermosetting resin powder with an average particle size of 0.1–20 μm or 0.01–40 wt % of an epoxy resin powder with an average particle size of 0.1–20 μm and 0.01–40 wt % of a curing agent, with the remainder water.

12 Claims, No Drawings

LUBRICANT FOR PLASTIC WORKING

BACKGROUND OF THE INVENTION

1. Field of the Invention

The present invention relates to a lubricant for plastic working. The lubricant is useful as a non-graphite. lubricant in place of graphite lubricants, for the purpose of release during plastic working, i.e. forging, extrusion, rolling, pressing, wire drawing, and other metal working, and particularly hot or warm forging or extrusion.

2. Description of the Prior Art

Lubricants used for plastic working of metal usually consist of oil-dispersed or aqueous-dispersed graphite. The former is prepared by dispersing graphite in a composition of mineral oil mixed with an extreme-pressure agent, wax, or the like, and since most of such working is hot, there exists the risk of ignition and fuming, which are major problems from the standpoint of safety, working environment and health. The latter is prepared by dispersing graphite in water containing an extreme-pressure agent. The lubricity is equal to that of the aforementioned oil dispersions, while there is no problem of ignition and the workability is slightly superior; however, as long as graphite is used there is no change in the blackness pollution to the worker and the working environment, and thus a health issue remains.

Attempts have been made to develop lubricants for plastic working which do not use graphite, in order to overcome these problems in the working environment. Examples thereof include lubricants prepared by adding glass compositions to alkali metal salts of aromatic carboxylic acids (Japanese Unexamined Patent Publication No. 60–1293) and lubricants employing alkali metal salts of phthalic acid .(Japanese Unexamined Patent Publication No. 58–84898). In order to overcome the above-mentioned problems of lubricants, the present applicant has also proposed lubricants employing alkali metal salts of alicyclic hydrocarbon dibasic acids or mixtures of alkali metal salts of such dibasic acids and alkali metal salts of fumaric acid (Japanese Unexamined Patent Publication No. 1–299895); nevertheless, from a practical standpoint their lubricity and releasability are inferior in comparison to graphite lubricants, and this results in disadvantages such as occurrence of product defects, reduction in workability and reduction in mold life.

Although the conventionally used alkali metal salts of carboxylic acids such as phthalic acid and fumaric acid are effective as heat resistant lubricant components, they differ from colloidal graphite which is a laminar solid lubricant, and lubricants under extreme pressure have low dispersability and are prone to film cracking between the mold and the worked product during the plastic working. As a result, the lubrication of the mold is reduced, sticking occurs, and abrasiveness of the mold is increased.

SUMMARY OF THE INVENTION

As a result of various research in regard to adhesion of lubricants and to the film lubricity and strength thereof during plastic working, and particularly hot forging and extrusion, the present inventors have found that excellent lubricant releasability and improved working efficiency may be attained by combining an alkali metal salt of an alicyclic polyvalent carboxylic acid as a heat-resistant lubricating component, with a thermosetting resin powder which has satisfactory mold adherence during plastic working and a water-soluble polymeric compound which imparts high-temperature adhesion to the lubricating component, and thus the present invention has been completed.

In other words, it is an object of the present invention to provide a lubricant for plastic working which has properties close to those of graphite lubricants while producing none of the disadvantages characteristic to graphite lubricants.

In order to overcome the above-mentioned problems, the present invention provides a lubricant for plastic working which contains 0.01–40 wt % of an alkali metal salt of an alicyclic polyvalent carboxylic acid, 0.01–40 wt % of a thermosetting resin powder with an average particle size of 0.1–20 μm, 0.01–20 wt % of a water-soluble polymeric compound, and the remainder water.

The present invention also provides a lubricant for plastic working which contains 0.01–40 wt % of an alkali metal salt of an alicyclic polyvalent carboxylic acid, 0.01–20 wt % of a water-soluble polymeric compound, 0.01–40 wt % of an epoxy resin powder with an average particle size of 0.1–20 μm, 0.01–40 wt % of a curing agent, and the remainder water.

DESCRIPTION OF THE PREFERRED EMBODIMENTS

Of alkali metal salts of organic carboxylic acids, alkali metal salts of alicyclic polyvalent carboxylic acids are already known to have particularly superior lubricity (Japanese Unexamined Patent Publication No. 1-299895). On the other hand, thermosetting resin powders begin their thermosetting from the time they adhere to high-temperature molds, and since the conversion to resin proceeds even more in the case of powders, the heat resistance is improved and a hard resin film is formed on the surface of the mold, thus preventing cracking of the lubricating film. When epoxy resin powders are used with curing agents, the epoxy resin powder begins thermosetting by reaction with the curing agent from the time it adheres to the high-temperature mold, and since the conversion to resin proceeds even more in the case of powders, the heat resistance is improved and a hard resin film is formed on the surface of the mold, thus preventing cracking of the lubricating film. In addition, water-soluble polymeric compounds improve adhesion of the lubricating component to the high-temperature mold, to allow formation of a more uniform lubricating film.

As alicyclic polyvalent carboxylic acids for the alkali metal salt of an alicyclic polyvalent carboxylic acid which may be used according to the present invention, there may be mentioned, for example, cyclohexanedicarboxylic acids such as hexahydrophthalic acid, hexahydroisophthalic acid and hexahydroterephthalic acid; cyclohexenedicarboxylic acids such as tetrahydrophthalic acid, tetrahydroisophthalic acid and tetrahydroterephthalic acid; and cyclohexadienecarboxylic acids, dicyclohexyldicarboxylic acids, etc. Of these, tetrahydrophthalic acid is preferred. The alkali metal salts of these alicyclic polyvalent carboxylic acids are preferably present in an amount of 0.01–40 wt %. If the content is less than 0.01 wt % the lubricity will be insufficient, while if it exceeds 40 wt % it will be impossible to obtain a stable aqueous solution. The use of alkali metal salts of these carboxylic acids is for the purpose of achieving thermal stability, and the alkali metal salt is preferably a sodium, potassium or lithium salt.

Thermosetting resins which may be used according to the present invention include, for example, xylene-formaldehyde resins, polyimide resins, urea resins, melamine resins and guanamine resins, with xylene-formaldehyde resins being particularly preferred. Naturally, these resins may also be modified. For example, in the case of xylene-formaldehyde resins, they may be not only the straight resins but also modified with phenols (novolac-modified, resol-modified), modified with amines, modified with carboxylic acids, modified with alcohols, modified with aromatic hydrocarbons, modified with epoxides, or modified with isocyanates. The powders of these thermosetting resins, preferably with an average particle size of 0.1–20 μm, are present in the lubricant of the present invention in an amount of 0.01–40 wt %. With an average particle size of less than 0.1 μm the adhesion is irregular and thus not suitable for practical use, and with an average particle size exceeding 20 μm, the stability of the product and the lubricating diluent at the time of use are poor, making it impossible to obtain a worked product with stable quality. The average particle size is the value measured using a SALD-1100 laser diffraction particle-size distribution measuring apparatus (manufactured by Shimazu Seisakujo). Also, if the content is less than 0.01 wt % it is difficult to form an adhesive film, while if it exceeds 40 wt % the lubricity is reduced and greater heating residue is left in the mold, tending to result in underfill.

Water-soluble polymeric compounds which may be used according to the present invention include, for example, hydroxyethyl cellulose, carboxymethyl cellulose, sodium polycarboxylate, ammonium polycarboxylate, sodium polystyrene maleate, and the like. These water-soluble polymeric compounds are preferably present in an amount of 0.01–20 wt %. If the content thereof is less than 0.01 wt % it is difficult to obtain the effect as an adhering agent, while if it exceeds 20 wt % the viscosity is notably increased thus complicating its handleability as a product.

The epoxy resin used according to the present invention may be, for example, a bisphenol A-type epoxy resin, bisphenol F-type epoxy resin, alcohol ether-type epoxy resin, cresol/novolac-type epoxy resin, glycidyl amine-type epoxy resin, naphthalene-type epoxy resin or dicyclo-type epoxy resin. The powders of these epoxy resins, preferably with an average particle size of 0.1–20 μm, are present in the lubricant of the present invention in an amount of 0.01–40 wt %. With an average particle size of less than 0.1 μm the adhesion is irregular and thus not suitable for practical use, and with an average particle size exceeding 20 μm, the stability of the product and the lubricating diluent at the time of use are poor, making it impossible to obtain a worked product with stable quality. The average particle size is the value measured using a SALD-1100 laser diffraction particle-size distribution measuring apparatus (manufactured by Shimazu Seisakujo). Also, if the content is less than 0.01 wt % it is difficult to form an adhesive film, while if it exceeds 40 wt % the lubricity is reduced and greater heating residue is left in the mold, tending to result in underfill.

The curing agent used according to the present invention may be an amine such as diethylenetriamine, triethylenetetramine, benzyldimethylamine, phenylenediamine or dicyandiamide, or an acid anhydride such as phthalic anhydride, hexahydrophthalic anhydride, tetrahydrophthalic anhydride, or the like. These curing agents are preferably present in an amount of 0.01–40 wt %. If the content thereof is less than 0.01 wt % the curing will be more difficult, whereas if it exceeds 40 wt % the stability of the product will be poorer and the post-curing properties will be reduced, making it impossible to achieve adequate performance as a releasing agent for forging.

The lubricant for plastic working according to the present invention comprises the 3 or 4 components mentioned above and water, but in addition to these components it may also contain appropriate amounts of (1) an alkali metal salt of any carboxylic acid including adipic acid, isophthalic acid and fumaric acid; calcium carbonate, kaolin, talc, clay, bentonite or another type of solid lubricant as a lubrication aid, or (2) a preservative, dispersant, rust preventive, antifoaming agent or other additive as a product adjuster.

The present invention is more thoroughly explained below by way of the following examples and comparisons. Unless otherwise specified, the percentages in the examples and comparisons refer to weight.

EXAMPLES 1–10 AND COMPARISONS 1–8

The components listed in the following Tables 1 and 2 were mixed to prepare lubricants according to the present invention and lubricants for comparison.

TABLE 1

| | Examples | | | | | Comparisons | | | | |
|---|---|---|---|---|---|---|---|---|---|---|
| | 1 | 2 | 3 | 4 | 5 | 1 | 2 | 3 | 4 | 5 |
| Alicyclic polyvalent carboxylic acid salt Na tetrahydrophthalate | 20 | 15 | 10 | 20 | 20 | | 20 | | | 20 |
| Polyvalent carboxylic acid salt Na isophthalate | | | | | | 20 | | | | |
| Thermosetting resin Xylene-formaldehyde resin | 5 | 5 | 5 | 10 | 15 | | | 20 | 5 | 5 |
| Water-soluble polymeric compound Na polystyrene maleate | 5 | 5 | 5 | 5 | 5 | 5 | 5 | 5 | 5 | |
| Water | 70 | 75 | 80 | 65 | 60 | 75 | 75 | 75 | 90 | 75 |

The thermosetting resin used above was a novolac-modified xylene-formaldehyde resin (NICANOL GP-21, average particle size: 2.4 μm), manufactured by Mitsubishi Gas Kagaku, K.K. The water-soluble polymeric compound used was sodium polystyrene maleate (DISPATEX SMA), manufactured by Nikka Kagaku, K.K.

TABLE 2

| | Examples | | | | | Comparisons | | |
|---|---|---|---|---|---|---|---|---|
| | 6 | 7 | 8 | 9 | 10 | 6 | 7 | 8 |
| Alicyclic polyvalent carboxylic acid salt Na tetrahydrophthalate | 20 | 15 | 10 | 20 | 20 | | | 20 |
| Polyvalent carboxylic acid salt Na isophthalate | | | | | | | | |
| Epoxy resin A | 5 | 5 | 5 | | 10 | 20 | 5 | 5 |
| Epoxy resin B | | | | 5 | | | | |
| Water-soluble Polymeric compound Na polystyrene maleate | 5 | 5 | 5 | 5 | 5 | 5 | 5 | |
| Curing agent Dicyandiamide | 1 | 1 | 1 | 1 | 2 | 4 | 1 | 1 |
| Water | 69 | 74 | 79 | 69 | 63 | 71 | 89 | 74 |

The epoxy resins used above were cresol-novolac epoxy resin (EPICLON N-690: trademark) (Epoxy resin A) and bisphenol A epoxy resin (EPICLON 7050: trademark) (Epoxy resin B), manufactured by Dainihon Ink Kagaku, K.K. These resins were used after pulverization to an average particle size of 2.0 μm. The water-soluble polymeric compound used was sodium polystyrene maleate (DISPATEX SMA: trademark), manufactured by Nikka Kagaku, K.K. The curing agent used was dicyandiamide, manufactured by Nihon Carbide, K.K.

The properties of the lubricants were evaluated by the methods described below.

Friction coefficient

The friction coefficient (μ) was determined by a ring compression test. Upper and lower ϕ120×50 mm molds (SKD61, quench hardened) are heated to about 200° C, and 10 ml of 30-fold diluted lubricant (using water as the diluent) was applied by spraying onto the upper and lower mold surfaces which are to contact the ring. Meanwhile, a ϕ30×ϕ15×10 mm ring (S45C material) was heated to 1000° C. with an electric furnace in an Ar atmosphere. The decrement in the-height of the ring, (processing degree: 60%) and rate of change of the inner diameter were plotted on a theoretical curve determined according to "The Kudo Energy Method" (Proc. 5th Japan Nat. Cong. Appl. Mech., (1955), 75), to calculate the friction coefficient. The results are shown in Tables 3 and 4 below.

TABLE 3

| Sample | | Friction coefficient (μ) |
|---|---|---|
| Examples | 1 | 0.182 |
| | 2 | 0.185 |
| | 3 | 0.198 |
| | 4 | 0.180 |
| | 5 | 0.180 |
| Comparisons | 1 | 0.230 |
| | 2 | 0.203 |
| | 3 | 0.265 |
| | 4 | 0.290 |
| | 5 | 0.216 |

TABLE 4

| Sample | | Friction coefficient (μ) |
|---|---|---|
| Examples | 6 | 0.180 |
| | 7 | 0.185 |
| | 8 | 0.195 |
| | 9 | 0.183 |
| | 10 | 0.185 |
| Comparisons | 6 | 0.270 |
| | 7 | 0.275 |
| | 8 | 0.220 |

Galling tendency

The galling tendency was confirmed by the following extrusion experiment. A ϕ30 mm punch mold with a draft angle of 1° (SKD61, quench hardened) was heated to about 250° C, and 3 ml of 30-fold diluted lubricant (using water as the diluent) was applied thereto by hand spraying (4 kg/cm$^2$). Meanwhile, a ϕ36.5×50 mm test piece (S45C material) was heated to 1000° C. with an electric furnace in an Ar atmosphere. The punch mold and the test piece were set on a 120 ton oil hydraulic press and compressed. The same procedure was repeated 8 times with different test pieces, and the condition of the punch mold thereafter was observed. The apparatuses were modified to allow separation of the two upon withdrawal even in cases where the test pieces and punch molds produced galling. The results are shown in Tables 5 and 6 below.

TABLE 5

| Sample | | Galling |
|---|---|---|
| Examples | 1 | None |
| | 2 | None |
| | 3 | None |
| | 4 | None |
| | 5 | None |
| Comparisons | 1 | 7th time |
| | 2 | 3rd time |
| | 3 | 5th time |
| | 4 | 2nd time |
| | 5 | 2nd time |

TABLE 6

| Sample | | Galling |
|---|---|---|
| Examples | 6 | None |
| | 7 | None |
| | 8 | None |
| | 9 | None |
| | 10 | None |
| Comparisons | 6 | 6th time |
| | 7 | 2nd time |
| | 8 | 2nd time |

In the case where sodium tetrahydrophthalate was used alone with the water-soluble polymeric compound (Comparison 2), transverse discontinuity occurred due to galling at the R-section of the punch mold. The same result occurred in the cases where xylene-formaldehyde resin alone was used (Comparisons 3 and 4). The same result also occurred in the cases where the epoxy resins alone were used (Comparisons 6 and 7).

Nevertheless, with the lubricants consisting of mixtures of the 3 components sodium tetrahydrophthalate, a xylene-formaldehyde resin and a water-soluble polymeric compound (Examples 1–5), no such galling occurred, and satisfactory lubricity was exhibited.

In addition, with the lubricants consisting of mixtures of the 4 components sodium tetrahydrophthalate, an epoxy resin, a curing agent and a water-soluble polymeric compound (Examples 6–10) as well, no such galling occurred, and satisfactory lubricity was exhibited.

Adhesion

The degree of adhesion was measured by an adhesion test. A polished and washed steel plate (S45C, 100 mm ×80 mm) was subjected to the adhesion test using air spray, with a steel plate temperature of 200° C., a spraying pressure of 4 kg/cm$^2$, a spray volume of 3 ml, and with 20- and 40-fold dilutions (water used for both dilutions), to determine the degree of adhesion. A spray distance of 30 cm was used, without moving the spray nozzle, to approximate the actual conditions. The results are shown in Tables 7 and 8.

TABLE 7

| Sample | | Adhesion (mg) 20-fold dilution | 40-fold dilution |
|---|---|---|---|
| Examples | 1 | 30.4 | 12.1 |
| | 2 | 24.6 | 10.0 |
| | 3 | 15.9 | 7.3 |
| | 4 | 33.2 | 13.8 |
| | 5 | 39.5 | 15.4 |
| Comparisons | 1 | 22.5 | 10.0 |
| | 2 | 14.4 | 4.1 |
| | 3 | 15.8 | 6.5 |

TABLE 7-continued

| Sample | | Adhesion (mg) 20-fold dilution | 40-fold dilution |
|---|---|---|---|
| | 4 | 5.2 | 2.3 |
| | 5 | 8.7 | 1.8 |

TABLE 8

| Sample | | Adhesion (mg) 20-fold dilution | 40-fold dilution |
|---|---|---|---|
| Examples | 6 | 30.0 | 11.9 |
| | 7 | 24.0 | 10.3 |
| | 8 | 15.7 | 7.0 |
| | 9 | 30.3 | 12.3 |
| | 10 | 33.1 | 13.6 |
| Comparisons | 6 | 15.5 | 6.7 |
| | 7 | 5.1 | 2.5 |
| | 8 | 8.5 | 1.7 |

Evaluation with actual device

An evaluation was also made with an actual device. An automobile part (S45C material) was subjected to a hot forging test using a 1000 ton press. Airless automatic spray was used at a mold temperature of 250° C, and a pressure of 5 kg/cm$^2$. The material temperature was 1250° C. Spraying was continued for about 2–3 seconds while the mold was open. The degree of dilution was 30-fold (using water as the diluent). The results are shown in Table 9.

TABLE 9

| Sample | Underfill | Sticking | Mold abrasiveness | Working efficiency |
|---|---|---|---|---|
| Example 1 | ◎ | ◎ | ◎ | ◎ |
| Example 6 | ◎ | ◎ | ◎ | ◎ |
| Comparison 2 | ○ | ○ | Δ | ◎ |
| Comparison 3 | Δ | ○ | ◎ | ◎ |

Evaluation criteria: ◎: Very good ○: Good Δ: Somewhat poor x: Poor

As a result of the working evaluation, the lubricants according to the present invention (Examples 1 and 6) were found to exhibit superior performance over the lubricants of the comparisons (Comparisons 2 and 3) with respect to lubricity (no underfill), releasability (no sticking) and mold abrasiveness. At the same time, the lubricants were of the so-called white-type which contained no graphite, and therefore an improved working environment was also achieved.

The lubricants of the present invention provide excellent lubricity and releasability for plastic working which has conventionally not been applicable to white lubricants, and productivity is also greatly improved. Furthermore, since the lubricants-are white, it is also possible to achieve improved working efficiency.

We claim:

1. A lubricant for plastic working which contains 0.01–40 wt % of an alkali metal salt of an alicyclic polyvalent carboxylic acid, 0.01–40 wt % of a thermosetting resin powder with an average particle size of 0.1–20 μm, 0.01–20 wt % of a water-soluble polymeric compound, and the remainder water.

2. A lubricant according to claim 1, wherein said alicyclic polyvalent carboxylic acid is selected from the group consisting of cyclohexanedicarboxylic acids, cyclohexenedicarboxylic acids, cyclohexadienecarboxylic acids and dicyclohexyldicarboxylic acids.

3. A lubricant according to claim 2, wherein said alicyclic polyvalent carboxylic acid is tetrahydrophthalic acid.

4. A lubricant according to claim 1, wherein said thermosetting resin is selected from the group consisting of xylene-formaldehyde resins, polyimide resins, urea resins, melamine resins and guanamine resins.

5. A lubricant according to claim 4, wherein said thermosetting resin is a xylene-formaldehyde resin.

6. A lubricant according to claim 1, wherein said water-soluble polymeric compound is selected from the group consisting of hydroxyethyl cellulose, carboxymethyl cellulose, sodium polycarboxylate, ammonium polycarboxylate and sodium polystyrene maleate.

7. A lubricant for plastic working which contains 0.01–40 wt % of an alkali metal salt of an alicyclic polyvalent carboxylic acid, 0.01–20 wt % of a water-soluble polymeric compound, 0.01–40 wt % of an epoxy resin powder with an average particle size of 0.1–20 μm, 0.01–40 wt % of a curing agent, and the remainder water.

8. A lubricant according to claim 7, wherein said alicyclic polyvalent carboxylic acid is selected from the group consisting of cyclohexanedicarboxylic acids, cyclohexenedicarboxylic acids, cyclohexadienecarboxylic acids and dicyclohexyldicarboxylic acids.

9. A lubricant according to claim 8, wherein said alicyclic polyvalent carboxylic acid is tetrahydrophthalic acid.

10. A lubricant according to claim 7, wherein said epoxy resin is selected from the group consisting of bisphenol A-type epoxy resin, bisphenol F-type epoxy resin, alcohol ether-type epoxy resin, cresol/novolac-type epoxy resin, glycidyl amine-type epoxy resin, naphthalene-type epoxy resin and dicyclo-type epoxy resin.

11. A lubricant according to claim 7, wherein said curing agent is selected from the group consisting of amines and acid anhydrides.

12. A lubricant according to claim 7, wherein said water-soluble polymeric compound is selected from the group consisting of hydroxyethyl cellulose, carboxymethyl cellulose, sodium polycarboxylate, ammonium polycarboxylate and sodium polystyrene maleate.

* * * * *